US005775696A

United States Patent [19]

Sidlow et al.

[11] Patent Number: 5,775,696

[45] Date of Patent: Jul. 7, 1998

[54] GAMING TABLE LAYOUT

[75] Inventors: Peter Sidlow; Norman Domsky, both of Las Vegas, Nev.

[73] Assignee: Casino Concepts Company, Las Vegas, Nev.

[21] Appl. No.: 600,307

[22] Filed: Feb. 12, 1996

[51] Int. Cl.[6] ..... A63F 3/00; A47B 25/00

[52] U.S. Cl. ..... 273/274; 273/309

[58] Field of Search ..... 273/274, 146, 273/145 CA, 142 J, 309

[56] References Cited

U.S. PATENT DOCUMENTS

| | | | |
|---|---|---|---|
| 4,185,828 | 1/1980 | Fernandez | 273/142 J |
| 4,659,087 | 4/1987 | Shen et al. | 273/274 |
| 4,688,803 | 8/1987 | Ollington | 273/274 |
| 4,746,126 | 5/1988 | Angileri | 273/249 |
| 4,836,553 | 6/1989 | Suttle et al. | 273/292 |
| 4,887,819 | 12/1989 | Walker | 273/256 |
| 4,902,019 | 2/1990 | Berman | 273/256 |
| 5,265,882 | 11/1993 | Malek | 273/292 |
| 5,308,081 | 5/1994 | Bartle | 273/274 |
| 5,350,175 | 9/1994 | DiLullo et al. | 273/146 |
| 5,513,851 | 5/1996 | Harris | 273/274 |
| 5,573,248 | 11/1996 | Parra et al. | 273/274 |

OTHER PUBLICATIONS

Home Mechanix, "Room Board" by Lars Dalsgaard, pp. 50–52 and 54, Nov. 1988.

*Primary Examiner*—Benjamin H. Layno
*Attorney, Agent, or Firm*—Quirk & Tratos

[57] ABSTRACT

A gaming table surface has three or more substantially identical wagering stations, each of the stations spaced apart from the other of stations for placing bets by a different player, each of the stations having plurality of spaces with indicia corresponding to different combinations of two numbers from one to six, respectively.

38 Claims, 2 Drawing Sheets

GAMING TABLE LAYOUT

BACKGROUND OF THE INVENTION

Craps is a well known and popular casino game. Craps is played on a rather large table usually requiring two or three dealers with no limit to the number of players that can play at a single table. The players may place bets on a larger number of betting areas which include proposition bets, come, field, don't pass and pass bets. One of the players throws dice against an interior wall at one end of the table with winners, losers and pushes being determined by the different combinations of the spots or pips on the dice. As popular as Craps is, because of the relatively large number of betting areas and bets that may be placed and the complexity of the Craps table layout, it is often complicated and intimidating to inexperienced players. The game of the present invention is somewhat similar to Craps in providing the excitement of making proposition wagers, but with each player having his or her own simplified betting area or station, with each game being played out with only a single roll of a pair of dice or a single roll of a pair of balls or other objects having numbers from 1 to 6. All wagers are decided with one roll of the dice or other object pair whereby players are not required to follow and track bets for any extended period of time.

SUMMARY OF THE INVENTION

The present invention comprises two different embodiments, one in which a pair of dice are used, similar to a Craps game, and a second embodiment in which a pair of balls or other objects having numbers 1 to 6 are rolled, popped or otherwise discharged from an apparatus for mixing and ejecting the balls or objects. Both embodiments of the game can be played on a standard size blackjack table, usually accommodating up to seven players, with each player having his or her own betting area and station around the perimeter of the table. A single dealer manages the game, and preferably activates the roll or play of the dice, balls or other objects and oversees the play on the table. All wagers are one roll wagers that are settled by payment, forfeiture or push prior to the next roll. These as well as other objects and features of the method of play and the table layout will be described in the detailed description of the invention.

DETAILED DESCRIPTION OF THE INVENTION

Figure 1:
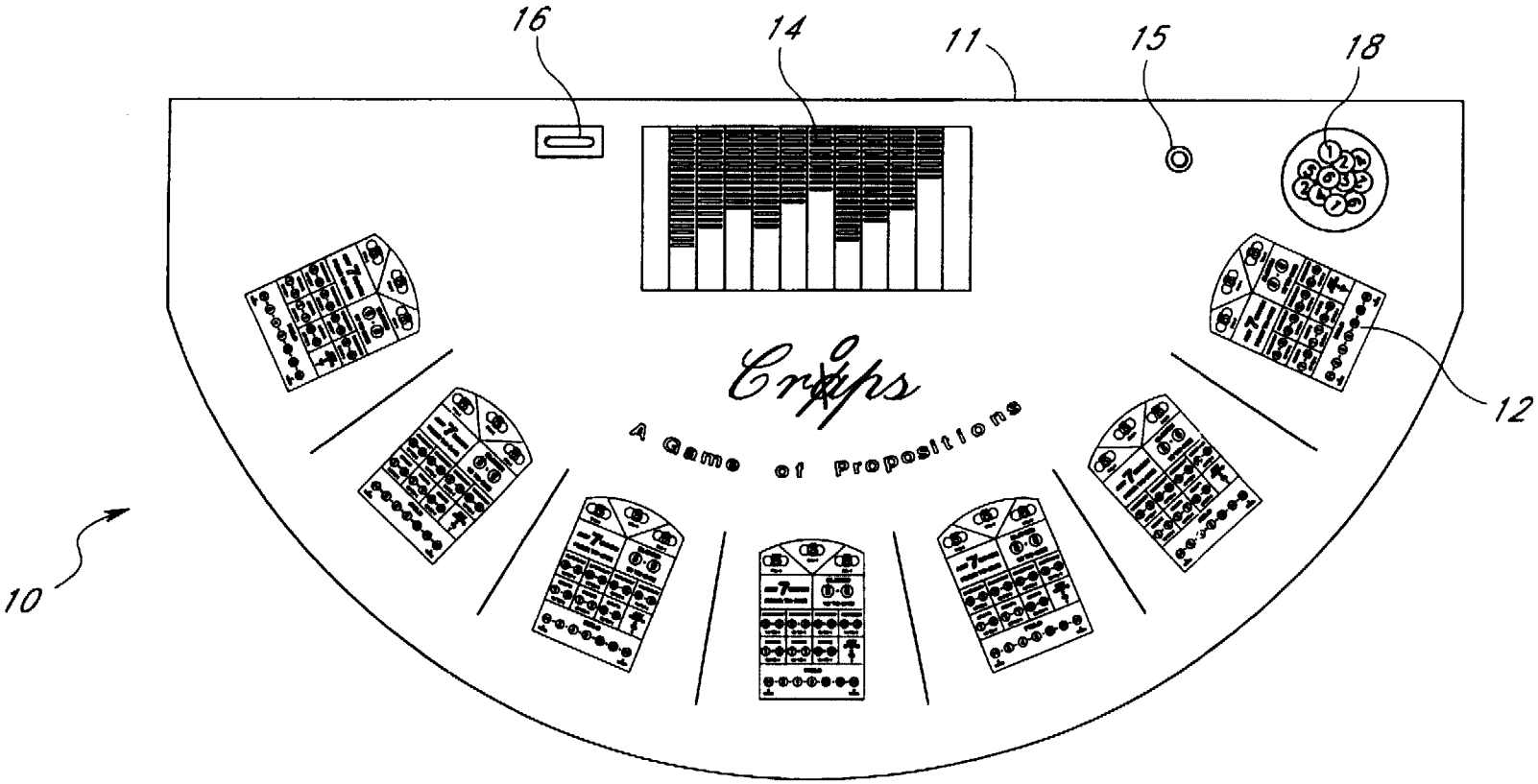
FIG. 1 illustrates the preferred table layout of one embodiment of the game.

In FIG. 1 a surface layout for playing a game according to the invention is shown. Such a layout comprises a generally semi-circular playing surface in which the wagering stations for the individual players are around the semi-circular perimeter with the dealer's station located generally at the center of the semi-circle opposite the player's stations similar to a Blackjack table. In the embodiment illustrated, a plurality of individual player stations 12 are positioned around the generally semi-circular perimeter of the table layout 10 with a dealer station or area 11 located adjacent to the chip tray 14 which holds playing or betting chips. A plurality of chips of different denominations are illustrated in the chip tray 14. The playing table also preferably includes a money drop 16 where the dealer inserts money received in payment for chips. The number of player stations provided on the playing surface depends on the desired maximum number of players to be accommodated on any single table during play of the game. Preferably, three or more, more preferably six or more and most preferably seven stations are provided for a casino operated game. Each of the separate player stations are preferably approximately the same size and are separated and spaced around the semi-circular table perimeter to provide adequate space for each individual player to stand and/or sit comfortably at his or her station. Of course, the distance between stations will depend on the size of the table, and again, a typical standard casino Blackjack table is preferred. It is also preferred that the specific player betting stations 12 be inset somewhat from the outside perimeter edge of the table to provide sufficient room for each player to stack chips outside of the waging or betting stations and closest to each player.

In an embodiment of the game in which a pair of dice is used for play, although a player may be selected for rolling the dice, preferably the dealer operates a dice shaker or cup and dispenses or rolls the dice therefrom, or the table includes an apparatus or device for shaking and dispensing the dice onto the table. An example of such an apparatus is known as a chuck-a-luck device, although any suitable apparatus for shaking and dispensing, rolling, discharging or ejecting the dice may be used.

In the embodiment shown in FIG. 1, a ball blower 18 is used for shaking or mixing and dispensing two balls at a time. The ball blower contains two sets of six balls, for a total of twelve balls, each set of balls having the numbers of 1 to 6 thereon. Such a ball blower is well known to those skilled in the art, for example of the type used for mixing and dispensing balls used in a Keno game. At the beginning of each game, the mixing and dispensing apparatus must contain two sets of the six balls numbered from 1 to 6. For each roll the dealer dispenses or "pops" the balls out of the blower, often referred to as a "two-pop-set". Similarly, if dice shaking and dispensing or shooting apparatus is used, the dealer actuates the apparatus for each roll, and then recovers the dice, or uses other dice available for the subsequent rolls in each game. FIG. 1 further illustrates a button 15 which may be pressed or actuated by the dealer when it is desired to operate the ball blower for mixing and dispensing a pair of balls. Other equivalent suitable ball mixing and dispensing devices may be used. Also, objects other than balls may be used for play such as sets of numbered discs, chips, tokens, etc., which may be mixed and dispensed from suitable apparatus.

Figure 2:
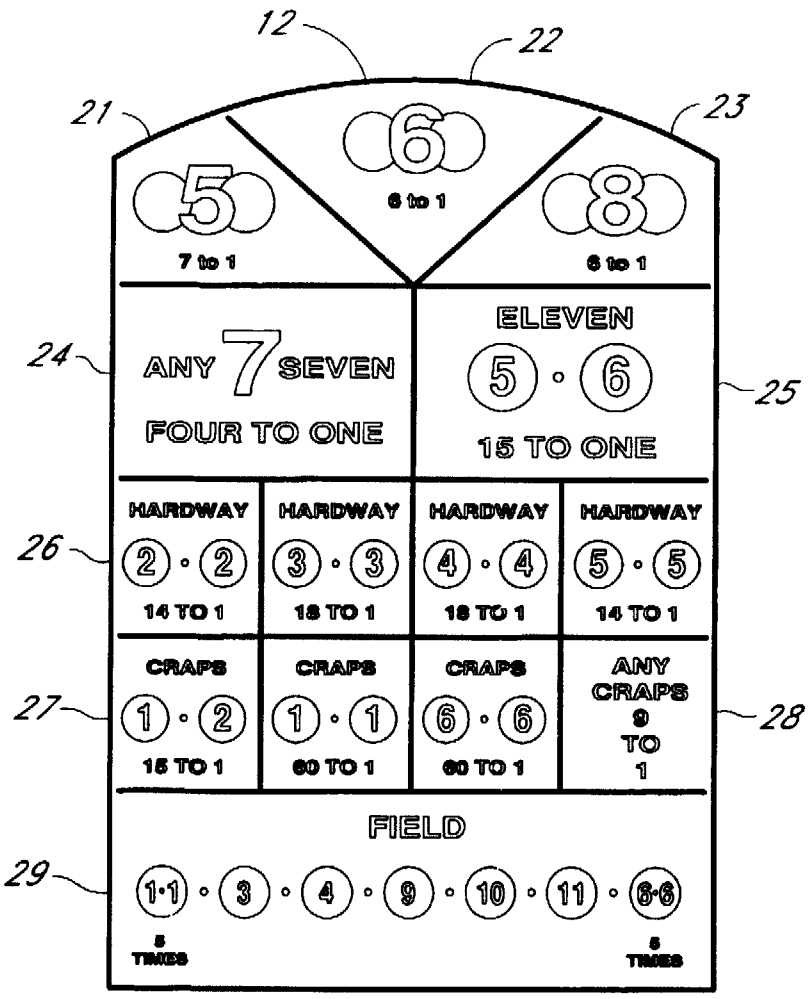
FIG. 2 illustrates a preferred wagering station used by each individual player.

FIG. 2 illustrates an individual player's wagering station 12 as shown in FIG. 1. Each player wagering station is substantially identical. The wagering stations comprise a plurality of spaces for placing bets, with each of the spaces having indicia corresponding to different combinations of pairs of balls that are dispensed in a single two-pop-set from the blower. The different spaces illustrated in FIG. 2 are preferred and include spaces 21, 22 and 23 for a combination of two balls which numbers total 5, 6 or 8, respectively. Spaces 24 and 25 are for any ball combinations which total 7, or 11, respectively. Four spaces 26 designated "hard way" are for betting pairs of balls in which each ball has the same number 2, 3, 4 or 5, respectively. Three "craps" spaces 27 are for pairs of balls both of which are a 1 or a 6, or in which one ball is 1 and other 2 as shown. An "any craps" space 28 is for betting on any of the "craps" combinations. A "field"

space 29 includes bets for any pair of 1's or 6's or any combination of numbers totalling 3, 4, 9, 10 or 11. The odds for the payoffs for bets in any of the respective betting spaces within the individual wagering stations are also preferably given as are shown in FIG. 2. The specific payoff odds shown in FIG. 1 are preferred and based on desirable and practical calculated house advantages, without considering the push. However, where desired, other odds may be used as agreed to by the players, or if a casino game, as established by the house and which may be authorized or approved by the responsible gaming authorities.

Figure 3:
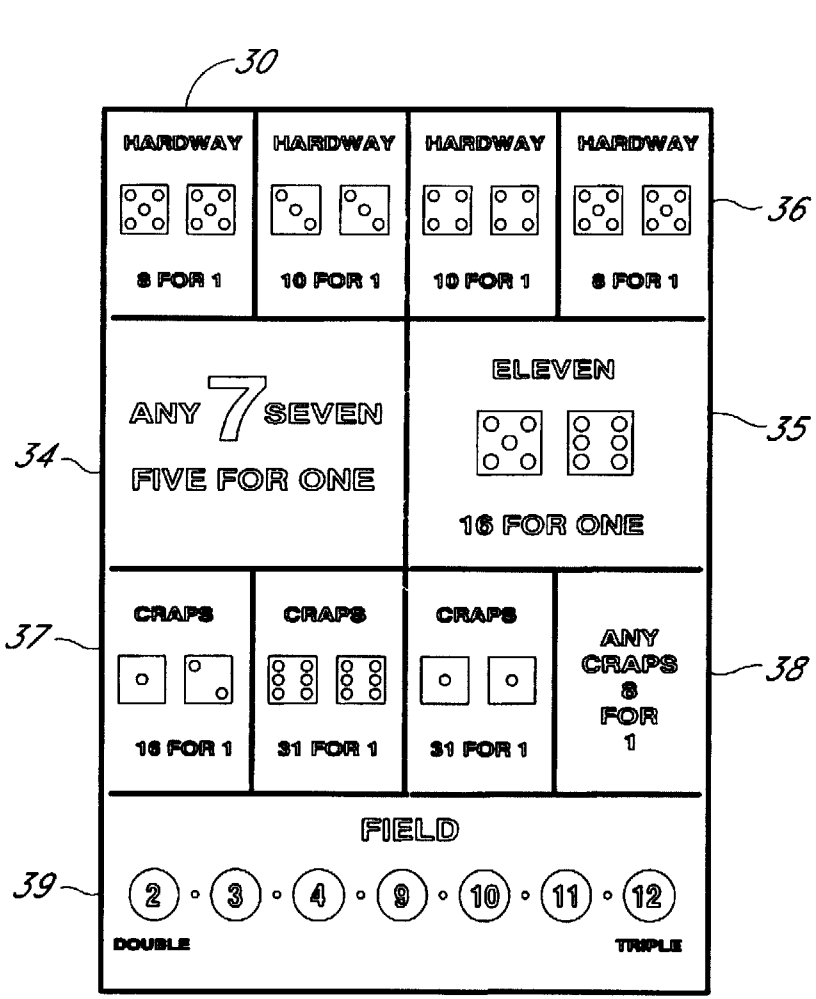
FIG. 3 illustrates another preferred wagering station used for the dice game embodiment.

In FIG. 3, the player station 30 is laid out differently from station 12 illustrated in FIG. 2. In the station of FIG. 3, the "hard way" bet spaces are shown along the upper or top area of the station, the seven and eleven spaces 34 and 35 are next below, the "craps" spaces 37 and "any craps" 38 below and the "field" space 39 at the bottom, similar to that shown in FIG. 2. However, the specific location of any of the different spaces within the player's station in either FIG. 2 or 3 can be modified and positioned wherever desired, and those shown, although preferred, are not critical. It will also be noted that the odds in the spaces for the individual bets shown in FIG. 3 are different from those of FIG. 2. The odds for dice games are those commonly used in Nevada for Craps proposition bets and are different than odds for a ball pop game as illustrated in FIGS. 1 and 2. However, again, the odds shown are preferred and calculated house odds, although they may be changed and varied as desired and authorized by the house and gaming authorities.

In playing a game according to the invention, fourteen basic wagers can be played by each player as follows:

1. ANY SEVEN (7): A player wagers that the total value of the two-pop-set will equal seven (7). Winning wagers are paid 4 to 1.
2. ANY CRAPS: A player wagers that the total value of the two-pop-set will be two (2), three (3) or twelve (12). Winning wagers are paid 9 to 1.
3. CRAPS TWO (2): A player wagers that the total value of the two-pop-set will be two (2). (Craps Two is also referred to as "Aces" or "Low".) Winning wagers are paid 60 to 1.
4. CRAPS THREE (3): A player wagers that the total value of the two-pop-set will be three (3). (Craps Three is also referred to as "Ace-Deuce".) Winning wagers are paid 15 to 1.
5. CRAPS TWELVE (12): A player wagers that the total value of the two-pop-set will be twelve (12). (Craps Twelve is also referred to as "High" or "Boxcars".) Winning wagers are paid 60 to 1.
6. ELEVEN (11): A player wagers that the total value of the two-pop-set will be eleven (11). Winning wagers are paid 15 to 1.
7. FOUR THE HARDWAY: A player wagers that the value on each ball will be identical/two (2) for a total value of four (4). Winning wagers are paid 14 to 1. If the value of the two-pop-set equals seven (7), then the wager is forfeited. If the total value of the two-pop-set equals four (4), but the values of the individual balls are not equal (i.e., 1–3, 3–1), then the wager is a loser. If the total value of the two-pop-set equals some number other than seven (7) or four (4), then the wager is a push.
8. SIX THE HARDWAY: A player wagers that the value on each ball will be identical/three (3) for a total value of six (6). Winning wagers are paid 18 to 1. If the total value of the two-pop-set equals seven (7), then the wager is forfeited. If the total of the two-pop-set equals six (6), but the values of the individual balls are not equal (i.e., 4–2, 5–1), then the wager is a loser. If the total value of the two-pop-set equals some number other than seven (7) or six (6), then the wager is a push.
9. EIGHT THE HARDWAY: A player wagers that the value on each ball will be identical/four (4) for a total value of eight (8). Winning wagers are paid 18 to 1. If the total value of the two-pop-set equals seven (7), then the wager is forfeited. If the total of the two-pop-set equals eight (8), but the values of the individual balls are not equal (i.e., 6–2, 3–5), then the wager is a loser. If the total value of the two-pop-set equals some number other than seven (7) or eight (8), then the wager is a push.
10. TEN THE HARDWAY: A player wagers that the value on each ball will be identical/five (5) for a total value of ten (10). Winning wagers are paid 18 to 1. If the total value of the two-pop-set equals seven (7), then the wager is forfeited. If the total of the two-pop-set equals ten (10), but the values of the individual balls are not equal (i.e., 6–4), then the wager is a loser. If the total value of the two-pop-set equals some number other than seven (7) or ten (10), then the wager is a push.
11. FIELD BET: A player wagers that the total value of the two-pop-set will be any of the totals of 2, 3, 4, 9, 11 or 12. Winning wagers for totals of 3, 4, 9, 10, and 11 pays even money, 1 to 1. Winning wagers for totals of 2, pays 5 to 1. Winning wagers for totals of 12, pays 5 to 1.
12. FIVE: A player wagers that the total value of the two-pop-set will be five (5). If the total value of the two-pop-set equals any number other than five (5) then this wager is forfeited. Winning wagers are paid 7 to 1.
13. SIX: A player wagers that the total value of the two-pop-set will be six (6). If the total value of the two-pop-set equals any number other than six (6) then this wager is forfeited. Winning wagers are paid 6 to 1.
14. EIGHT: A player wagers that the total value of the two-pop-set will be eight (8). If the total value of the two-pop-set equals any number other than eight (8) then this wager is forfeited. Winning wagers are paid 6 to 1.

For playing the dice game embodiment, the aforesaid basic wagers 12–14 are preferably eliminated, as illustrated in FIG. 3.

By way of example, a typical method of playing the game is as follows: the players will position themselves around a table layout of FIG. 1 adjacent to respective selected betting area stations, and the dealer will announce the start of the game. Players will then place their wagers in their respective betting box or station by placing chips or cheques in one or more of the desired betting spaces. The dealer then announces and signals that no more wagers are to be placed and activates the blower or the dice shaker/dispenser. After determining the value of the two-pop-set or the dice and the combination of the two balls or dice, the dealer settles all wagers by collection of losers, determination of pushes, and payment of winners. After all wagers are settled, the start of a new game will be announced.

An example of such play with three players at a table layout of FIG. 1 with FIG. 2 stations is as follows: the dealer announces the start of the game. Player A places a $5 cheque on the wager space or box marked "Eleven" and a $5 cheque on the wager space marked "Any Seven." Player B places a $1 cheque on each of the "Hard Way" wager spaces. Player C places a $25 cheque on the "Field" wager space. The dealer announces/signals no more bets and activates the blower. The two-pop-set balls are observed and the dealer calls the outcome two times, "Eleven, Eleven". Player A loses the $5 wager on "Any Seven" and wins the $5 wager on "Eleven." Player B neither wins or loses any "Hard Way" bets, which are pushes. Player B may elect to let these bets stand or pull them back. Player C wins the "Field" wager. The dealer settles the wagers by collection of losers, allowing pushes to stand and pays the winners. The dealer then announces a new game and the cycle repeats itself. Other embodiments, modifications or variations within the purview of the invention will be evident to those skilled in the art.

Preferred rules for playing a game according to the invention include: (1) all bets must be made in the exact amount intended as a wager by a player, (2) a wager made on any bet must be removed, reduced or increased prior to the dealer signalling no more wagers for the roll of dice or dispensing of balls that decides the outcome of that wager, (3) players cannot call off bets, and if a bet is not physically removed from the respective player's betting station prior to the dealer signalling no more wagers, it is a working wager and is in play, (4) currency/money plays are not allowed because the betting spaces in the wagering stations are not of a suitable size to accommodate currency, (5) call bets are not authorized unless they are approved by the house or casino, (6) players are responsible for the proper and accurate placement of wagers on the betting areas or boxes of their respective betting stations with chips or cheques neatly stacked, smaller denominations on top of larger denominations, including "field" bets in which chips are to be placed in the clearly marked wager spots in the "field" area, (7) if a player questions or disputes a dealer's call, it is responsibility of the player to notify the dealer of the dispute prior to settlement of any wager for that game (two-pop-set or roll), and (8) all wagers are one roll wagers and will be settled prior to the next roll or two-pop-set. If the game is played with dice, the standard craps or dice game rules preferably apply, for example: if one die lands or sits on top of the other die, it is a dead/void roll; if one die is cocked, the dealer calls what would be the natural roll of the dice, and if a player questions or disputes the dealer's call, it is the responsibility of the player to notify the dealer of the dispute prior to the settlement of any wagers for that roll. Moreover, any malfunction of a delivery system such as the blower or dice roller will constitute an invalid roll and void that roll or game.

What is claimed is:

1. A gaming table for playing a modified craps game comprising a surface having three or more substantially identical wagering stations thereon, each of said stations spaced apart from the other of said stations for placing bets thereon by a different player, each of said stations comprising a plurality of spaces having indicia thereon corresponding to different combinations of pips on a pair of dice.

2. A gaming table of claim 1 wherein said spaces include indicia showing payoff odds for bets placed therein.

3. A gaming table of claim 1 wherein said stations comprise a space for the following dice pair combinations:

pair of ones, pair of twos, pair of threes, pair of fours, pair of fives and pair of sixes.

4. A gaming table of claim 3 wherein said stations include a space for any dice pip combination of seven.

5. A gaming table of claim 4 wherein said stations include a space for a dice pip combination of three.

6. A gaming table of claim 5 wherein said stations include a space for any dice pip combination of eleven.

7. A gaming table of claim 6 wherein said stations include separate spaces for each of the following dice pip combinations: (a) pair of ones, (b) pair of sixes, (c) total of three, and (d) any (a), (b) or (c).

8. A gaming table of claim 6 wherein said spaces include a space corresponding to a Craps field for dice pip combinations of two, three, four, nine, ten, eleven and twelve.

9. A gaming table of claim 3 wherein said stations include a space for a dice pip combination of three.

10. A gaming table of claim 3 wherein said stations include a space for any dice pip combination of eleven.

11. A gaming table of claim 3 wherein said stations include separate spaces for each of the following dice pip combinations: (a) pair of ones, (b) pair of sixes, (c) total of three, and (d) any (a), (b) or (c).

12. A gaming table of claim 3 wherein said spaces include a space corresponding to a Craps field for dice pip combinations of two, three, four, nine, ten, eleven and twelve.

13. A gaming table of claim 1 having spaces for all of said dice combinations and wherein a different space is provided for each of said different combinations.

14. A gaming table of claim 1 wherein said stations include a space for any dice pip combination of seven.

15. A gaming table of claim 1 wherein said stations include a space for a dice pip combination of three.

16. A gaming table of claim 1 wherein said stations include a space for any dice pip combination of eleven.

17. A gaming table of claim 1 wherein said stations include separate spaces for each of the following dice pip combinations: (a) pair of ones, (b) pair of sixes, (c) total of three, and (d) any (a), (b) or (c).

18. A gaming table of claim 1 wherein said spaces include a space corresponding to a Craps field for dice pip combinations of two, three, four, nine, ten, eleven and twelve.

19. A gaming table of claim 18 wherein each of said spaces includes indicia showing payoff odds for bets placed in said space.

20. A gaming table of claim 1 including a dice shooting apparatus for rolling a pair of dice on said table.

21. A gaming table of claim 1 comprising six or more of said wagering stations.

22. A gaming table of claim 21 wherein said wagering stations are spaced apart adjacent to the perimeter.

23. A gaming table of claim 21 wherein each of said spaces includes indicia showing payoff odds for bets placed in said space.

24. A gaming table of claim 1 wherein none of said wagering stations include a space designating pass, don't pass or come bets.

25. A gaming table comprising a surface having three or more substantially identical wagering stations thereon, each of said stations spaced apart from the other of said stations for placing bets thereon by a different player, each of said stations comprising a plurality of spaces having indicia thereon corresponding to different combinations of two numbers from one to six, respectively.

26. A gaming table of claim 25 wherein said spaces include indicia showing payoff odds for bets placed therein.

27. A gaming table of claim 26 wherein said stations comprise a space for the following dice pair combinations: pair of ones, pair of twos, pair of threes, pair of fours, pair of fives and pair of sixes.

28. A gaming table of claim 26 wherein said stations include a space for any dice pip combination of seven.

29. A gaming table of claim 26 wherein said stations include a space for a dice pip combination of three.

30. A gaming table of claim 26 wherein said stations include a space for any dice pip combination of eleven.

31. A gaming table of claim 26 wherein said stations include separate spaces for each of the following dice pip combinations: (a) pair of ones, (b) pair of sixes, (c) total of three, and (d) any (a), (b) or (c).

32. A gaming table of claim 26 wherein said spaces include a space corresponding to a Craps field for dice pip combinations of two, three, four, nine, ten, eleven and twelve.

33. A gaming table of claim 26 wherein said stations include separate spaces for each of the following different combinations of two numbers: (a) pair of ones, (b) pair of sixes, (c) total of three, (d) any (a), (b) or (c), (e) pair of twos, (f) pair of threes, (g) pair of fours, (h) pair of fives, (i) total of five, (j) total of six, (k) total of seven, (l) total of eight, (m) total of eleven, and (n) any one combination corresponding to (a), (c), total of four, total of nine, total of ten, (m) or (b).

34. A gaming table of claim 33 wherein said spaces include indicia showing payoff odds for bets placed therein.

35. A gaming table of claim 33 comprising six or more of said wagering stations.

36. A gaming table of claim 35 wherein said wagering stations are spaced apart around and adjacent to the perimeter.

37. A gaming table of claim 26 including an apparatus having two sets of balls or objects numbered one to six, said apparatus capable of randomly mixing and discharging said balls or objects.

38. A gaming table of claim 25 wherein none of said wagering stations include a space designating pass, don't pass or come bets.

* * * * *